United States Patent [19]

Baran, Jr.

[11] Patent Number: 4,512,712

[45] Date of Patent: Apr. 23, 1985

[54] TURBINE STATOR ASSEMBLY

[75] Inventor: Walter J. Baran, Jr., South Glastonbury, Conn.

[73] Assignee: United Technologies Corporation, Hartford, Conn.

[21] Appl. No.: 518,907

[22] Filed: Aug. 1, 1983

[51] Int. Cl.[3] ..... F01D 25/08

[52] U.S. Cl. ..... 415/116; 415/178; 415/218; 411/337

[58] Field of Search ..... 415/179, 180, 178, 193, 415/175, 176, 218, 116; 411/337, 352, 353, 366, 84, 85, 103, 107, 116, 119

[56] References Cited

U.S. PATENT DOCUMENTS

| | | | |
|---|---|---|---|
| 2,623,727 | 12/1952 | McLeod | 415/117 |
| 2,984,454 | 5/1961 | Flori | 415/180 |
| 3,295,824 | 1/1967 | Woodwell et al. | 415/178 |
| 3,863,300 | 2/1975 | Becker | 411/366 |
| 3,990,807 | 11/1976 | Sifford | 415/115 |
| 4,005,946 | 2/1977 | Brown et al. | 415/178 |
| 4,053,254 | 10/1977 | Chaplin et al. | 415/178 |
| 4,257,222 | 3/1981 | Schwarz | 415/178 |

FOREIGN PATENT DOCUMENTS

| | | | |
|---|---|---|---|
| 2740432 | 3/1979 | Fed. Rep. of Germany | 411/337 |
| 1154684 | 6/1969 | United Kingdom | 411/337 |

*Primary Examiner*—Robert E. Garrett
*Assistant Examiner*—H. Edward Li
*Attorney, Agent, or Firm*—Charles A. Warren

[57] ABSTRACT

The stator vanes of an axial flow gas turbine are supported by spaced flanges in the surrounding turbine case one of which flanges supports the upstream end of the outer shroud of the vane radially and also serves to position the blade tip seal segments and the surrounding air seal ring. The other flange engages lugs from the vane shroud and also supports clips for the clip seal segments and the upstream edge of the air seal ring.

12 Claims, 4 Drawing Figures

TURBINE STATOR ASSEMBLY

DESCRIPTION

1. Technical Field

This invention relates to stator assemblies for an axial flow gas turbine including the assembly of stator vanes, air seals for the blade tips and a cooling air duct for a seal ring element within the turbine case.

2. Background Art

Where there is a flow of cooling air between the outer ends of the stator vanes and the engine case and between the blade tip air seals and the engine case there are problems in the secure attachment of the several elements particularly in view of the temperature gradients to which the parts are exposed during turbine operation. It is desirable also to make the air seals in a segmental assembly for thermal expansion purposes and it is essential to provide a continuous cooling air seal ring external to the segments to prevent leakage of cooling air. The present invention is intended to provide a construction that solves the several problems adequately. The arrangement of these elements allows continued operation of the gas turbine in the event of the loosening of one or more of the attaching bolts.

DISCLOSURE OF INVENTION

The present construction provides spaced inwardly extending flanges within the case arranged in pairs such that one flange is engaged by and supports the leading edges of the outer shrouds of a row of stator vanes and the other flange serves to hold the stator vanes in axial position by cooperating with outward flanges on the outer shrouds. The second or other flange also serves to support clips that are engaged by and position the blade tip air seal segments and also support one end of a surrounding ring that functions as the inner wall of the cooling air duct. The other end of the ring and the tip seal segments are engaged at their lower ends by the upstream ends of the vane shrouds and are thus held securely in radial position.

The several elements are held by bolts extending through one of the flanges and a novel clip is utilized to hold the bolt in place if it should become loose thereby preventing damage to the turbine.

The foregoing and other objects, features and advantages of the present inventon will become more apparent in the light of the following detailed description of the preferred embodiments thereof as shown in the accompanying drawing.

BEST MODE FOR CARRYING OUT THE INVENTION

Figure 1:
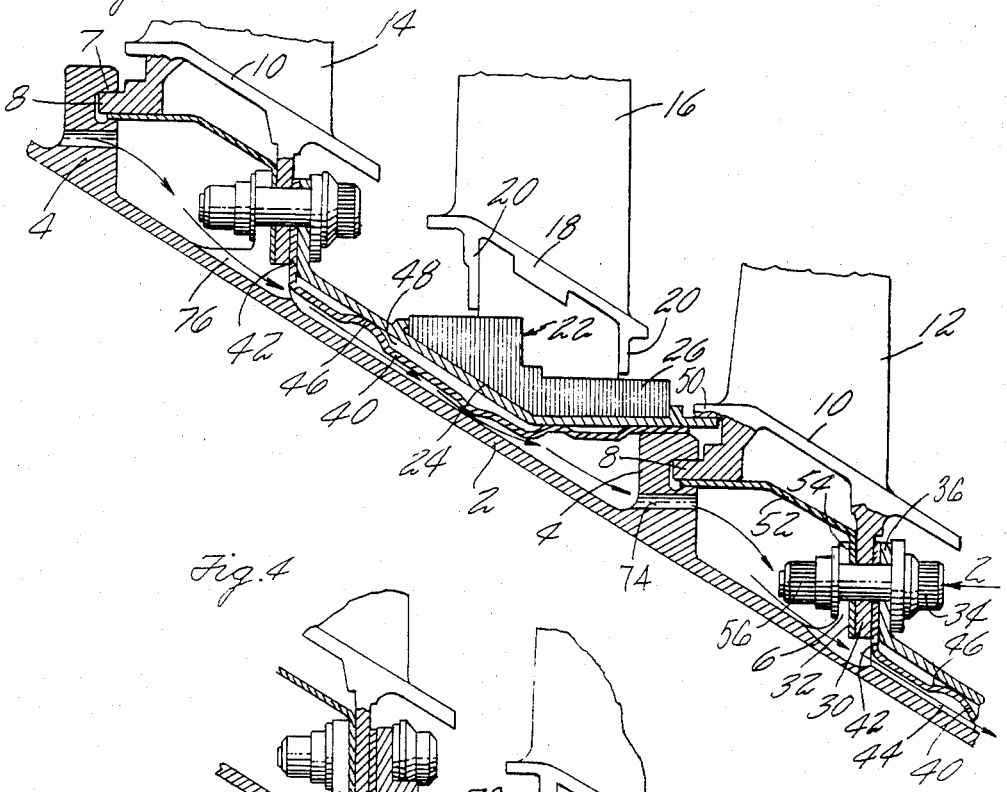
FIG. 1 is a longitudinal fragmentary sectional view through a portion of a gas turbine.

The engine case 2 has inwardly extending upstream flanges 4 and downstream flanges 6 spaced apart and arranged in pairs as shown. The flange 4 may be continuous and has a groove 7 in its downstream face to receive a projecting lug 8 on the outer shroud 10 of a turbine vane 12 forming one of the rows of stator vanes in the engine.

Figure 2:
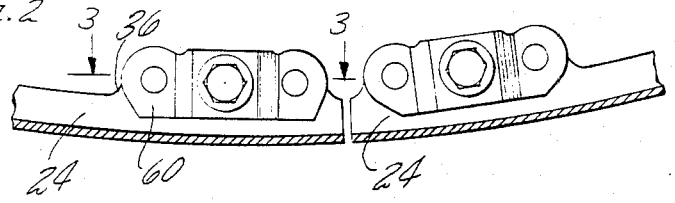
FIG. 2 is a fragmentary view in the direction of the arrow 2 of FIG. 1 showing the segments.

Spaced upstream from the vanes 12 is another row of vanes 14 supported in the same manner as the vane 12 as will be described. Positioned between the vanes 12 and the vanes 14 is a row of rotor blades 16 having on their outer shrouds 18 outwardly extending sealing fins 20. These fins 20 cooperate with tip seal segments 22 consisting of ring segments 24, FIG. 2, having on their inner surfaces honeycomb seal elements 26 which may be arranged in stepped relation if desired to cooperate with the similarly positioned seal fins 20.

As the vanes 12 or 14 are assembled in the case, the downstream flange 6 receives outwardly extending flanges 30 on the vane shroud, these flanges fitting in a circumferential notch 32 in the flange 6. These flanges are clamped by a row of bolts 34 and these bolts also serve to engage inwardly extending flanges 36 on the segments 24 to hold them in position in the case. There are at least two and preferably more flanges 36 for each seal segment as will be apparent.

The bolts 34 also hold in position a continuous air seal ring 40 having an inwardly extending flange 42 at its upper end to fit between the shroud lugs 30 and the flanges 36. This ring extends downstream from the clips in surrounding relation to the segments and defines a flow path 44 between it and the case. The ring is also preferably spaced from the segments utilizing dimples 46 in the ring to form a dead air space 48 between the ring and the segments. This ring and the surrounded air seal segments are frustoconical for a portion of the length at and near the upstream ends and the remainder of both ring and segments are cylindrical and in contact with one another. The lower edge of the ring is engaged by the inner surface of the flange 4 and this pilots the segments and the ring to hold them in radial position within the turbine case 2. A forwardly extending cylindrical flange 50 on each vane shroud engages the inner surfaces of the segments at their downstream edges to hold the segments against the surrounding ring and both segments and ring securely against the flange 4.

Surrounding the row of stator vanes is a ring 52 having its upper end held in position in the notch 7 by the lugs 8 and having on its lower end an outwardly extending flange 54 clamped between the flanges 30 on the vanes and the flange 6. This ring 52 forms an inner wall for a continuation of the cooling air path and prevents leakage of air into the turbine inside the ring 52.

Figure 3:
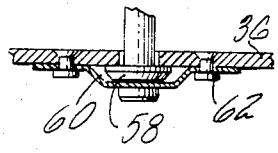
FIG. 3 is a sectional view on the line 3—3 of FIG. 2.

The bolts 34 extend through the flange 6 as shown. The nut 56 is preferably secured to the flange 6 and the bolt which is a standard bolt has a flange 58 thereon at the head that is received between the flange 36 and a bolt retainer 60, FIGS. 2 and 3, riveted as at 62 to the clip. The clip overlies the flange 58 and prevents the loss of the bolt in the event of its loosening. To permit assembly of the bolt to the clip, the latter is attached to the flange 36 after positioning the bolt in the flange 36.

Figure 4:
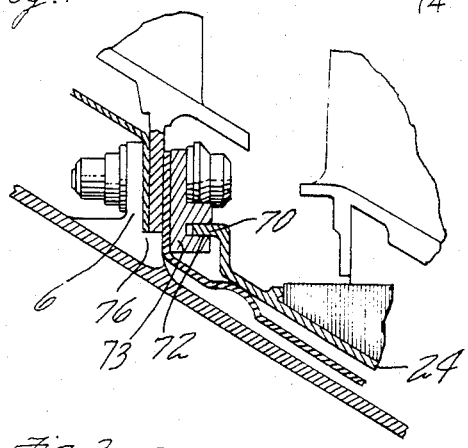
FIG. 4 is a fragmentary longitudinal sectional view corresponding to FIG. 1 showing a modification.

Referring to FIG. 4 the structure is much the same as above described except that the ring segments 24' have axially extending flanges 70 at the upstream ends and these flanges are received in axial slots 72 in clips 73 separate from the segments. This is a simple modification of the structure of FIG. 1 but it permits axial assembly of the segments into the already positioned clips and otherwise serves to perform the same function.

The flange 6 has notches 76 therein to form cooling air passages therethrough and the flange 4 has cooling passages 74 therein for the flow of cooling air through the cooling air path 44.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. A turbine stator construction including:

an annular turbine case having axially spaced pairs of inwardly extending circumferential flanges on its inner surfaces, each pair consisting of an upstream flange and a downstream flange spaced therefrom;

spaced rows of turbine vanes positioned within the case, each vane having an outer shroud and each shroud having a forwardly extending rib, a forwardly projecting lug spaced outwardly from the rib and an outwardly projecting flange;

the upstream flange having a groove in its downstream surface to receive the forwardly projecting lugs on the shrouds to hold them in radial position and the downstream flange having a notch engaging the outwardly projecting flanges on the shrouds;

a row of bolts extending through the dowstream flange and the outwardly projecting flanges to hold the shrouds and vanes in position;

a ring of air seal segments extending between the rows of vanes at their outer shrouds, and a row of clips held in position on the downstream side of the downstream flange by said bolts, said clips engaging the upstream edges of the segments and positioning the segments, the lower edges of the segments being engaged by the forwardly extending ribs on the shrouds, said ribs urging the segments outwardly to clamp the segments between the upstream flange surrounding the segments and said ribs.

2. A stator construction as in claim 1 including a continuous air seal ring surrounding the segments, said air seal ring having an inwardly extending flange at its upstream end to receive and be held in position by said row of bolts in the downstream flange, the downstream end of the ring engaging the inner surface of the upstream flange of the adjacent pair of flanges to be positioned thereby.

3. A turbine stator construction as in claim 2 in which the forwardly extending ribs on the shroud engage the inner surfaces of the segments at their downstream end to urge them outwardly against the air seal ring and thus hold the ring against the upstream flange.

4. A turbine stator construction as in claim 2 in which the continuous ring is dimpled to space the ring from the segments and from the surrounding case.

5. A turbine stator construction as in claim 1 in which the clips in the row of clips have notches in their downstream ends to receive the upstream edges of the segments.

6. A turbine stator construction as in claim 5 in which the notches are axial to receive the upstream edges of the segments and the upstream edges of the segments are also axial.

7. A turbine stator construction as in claim 1 in which each setment has a flange thereon, and a retainer surrounds the bolt head and is attached to the flange on the segment to hold the bolt in position, the bolt having a flange positioned between the segment flange and the retainer.

8. A turbine stator construction including:

an annular turbine case having axially spaced pairs of inwardly extending circumferential flanges on its inner surfaces, each pair consisting of an upstream flange and a downstream flange spaced therefrom;

spaced rows of turbine vanes positioned within the case, each vane having an outer shroud and each shroud having a forwardly extending rib, a forwardly projecting lug spaced outwardly from the rib and an outwardly projecting flange;

the upstream flange having a groove in its downstream surface to receive the forwardly projecting lugs on the shroud to hold them in radial position and the downstream flange having a notch on its downstream side to receive and engage the outwardly projecting flanges on the shrouds;

a row of bolts extending through the downstream flange and the outwardly projecting flanges on the shrouds to hold the shrouds and vanes in position;

a ring of air seal segments extending between the rows of vanes at their outer shrouds, each of said segments having inwardly extending flanges thereon to be held in position on the downstream flange by said bolts, said segment flanges being on the downstream side of the projecting flanges on the shrouds thereby positioning the segments, the lower edges of the segments being engaged by the forwardly extending ribs on the shrouds, said ribs urging the segments outwardly to clamp the segments between the upstream flange surrounding the segments and said ribs.

9. A stator construction as in claim 8 including a continuous air seal ring surrounding the segments, said air seal ring having an inwardly extending flange at its upstream end to receive and be held in position by said row of bolts of one of said pair of flanges, the downstream end of the ring engaging the inner surface of the upstream flange of the adjacent pair of flanges to be positioned thereby.

10. A turbine stator construction as in claim 9 in which the forwardly extending ribs on the shroud engage the inner surfaces of the segments to urge them outwardly against the air seal ring and thus hold the ring against the upstream flange.

11. A turbine stator construction as in claim 9 in which the continuous ring is dimpled to space the ring from the segments and from the surrounding case.

12. A turbine stator construction as in claim 8 in which a retainer surrounding the bolt head and attached to the flange on the segments holds the bolt in position, the bolt having a flange positioned between the segment flange and the retainer.

* * * * *